US005157874A

United States Patent [19]

Peng

[11] Patent Number: 5,157,874

[45] Date of Patent: Oct. 27, 1992

[54] ROTARY MULTI-BRUSHES

[76] Inventor: Shih-Jen Peng, 293 Pei Tun Rd., Taichung, Taiwan

[21] Appl. No.: 569,428

[22] Filed: Aug. 20, 1990

[51] Int. Cl.[5] ..... B24B 9/02; B24D 13/06; B24D 13/10

[52] U.S. Cl. ..... 51/181 R; 51/334

[58] Field of Search ..... 51/181 R, 332, 334, 51/335

[56] References Cited

U.S. PATENT DOCUMENTS 3,132,452 5/1964 Block ..... 51/181 R

FOREIGN PATENT DOCUMENTS 457870 6/1950 Italy ..... 51/181 R
0089566 6/1982 Japan ..... 51/334
715292 9/1954 United Kingdom ..... 51/181 R

*Primary Examiner*—Roscoe V. Parker

[57] ABSTRACT

A rotary sander comprising a cylindrical rotary drum carrying a plurality of brushes, a concentric inner retaining sleeve carrying a plurality of sanding units, and a circular top cover and bottom cover. The periphery of the rotary drum has a set of elongate receiving channels formed thereon in which the spines of the brushes are slidingly retained. Similarly, the sanding units have elongate holders that are retained within respective retaining grooves formed around the periphery of the retaining sleeve. Each of the sanding units has a pair of sandpaper sheets attached thereto with an external portion of the sheets passing through a corresponding pair of adjacent slots formed around the periphery of the drum. The slots are interposed between the receiving channels thereon so that an external portion of each sheet of sandpaper within the drum is disposed between a pair of adjacent brushes. The retaining sleeve is fixed in position within the drum by the top and bottom covers which releasably secure the assembly together. The top and bottom covers are also provided with central holes for the passing therethrough of a spindle.

5 Claims, 4 Drawing Sheets

PRIOR ART

PRIOR ART

ROTARY MULTI-BRUSHES

BACKGROUND OF THE PRESENT INVENTION

The present invention relates to a rotary sander and more particularly to a rotary sander having a structure which facilitates rapid disassembly and assembly for the replacement of the elements therein.

Referring to FIG. 1, a conventional type of rotary sander comprises a circular top cover 1 and bottom cover 2, a retaining sleeve 3 disposed therebetween, and a set of sanding units 4 secured to the sleeve and a set of brushes 5 retained by the covers.

The lower end portion of sleeve 3 is enscounced in a stepped diameter central hole 21 in the bottom cover while the upper coupling portion 31 thereof with a reduced diameter passes through a central hole 11 in the top cover. A circular partition plate 6 having a central hole is further provided and disposed between the shoulder of coupling portion 31 and the top cover, with a set of downwardly aligned protrusions 12 formed around hole 11 engaging corresponding apertures 61 formed around the central hole of the partition plate.

Sandpaper sheets 41 of each sanding unit 4 are first secured to the outer periphery of the retaining sleeve prior to assemblage with the covers.

To effect the securement, a corresponding edge portion of each sandpaper sheet is clamped to the periphery of sleeve 3 by an elongate clamping plate 42 whose ends are fastened to corresponding threaded holes 32 thereon with respective screws 421.

Radial and annular dividers in the peripheral portions of bottom cover 2 and partition plate 6, along with a circumferential rim 13 of the top cover 1, define respective sets of receiving recesses, 22 and 62, thereon for the positioning of the brushes.

Each brush 5 has an elongate spine 51 whose end portions are received within respective recesses, 22 and 62, on cover 2 and partition 6. A sandpaper sheet 41 extends through a gap defined between each pair of adjacent brushes 5 as shown in FIG. 4. An annular bonnet 7 having a set of downwardly aligned protrusions 71 is positioned over the protruding terminal end of the coupling portion 31 with the protrusions engaging corresponding radial slots 311 thereon.

At least two ribbons 8 are passed through the central bore of the assembly, defined by the central holes of the bonnet, top and bottom covers, and partition, and the hollow core of the retaining sleeve. The ribbons are wrapped axially over the drum and knottedly adjoined to secure the assembly together.

A major deficiency of this type of conventional rotary sander is that disassembly for the replacement of worn sandpaper or the cleaning of the brushes tends to be cumbersome and time consuming. In particular, after the ribbons 8 are first unknotted and the top cover removed, the removal and subsequent replacement of sandpaper sheets 41 requires the manipulation of a plurality of screws. Furthermore, it is not uncommon for the dust laden brushes to come free from bottom cover 2 upon the removal of the sleeve 3 and sanding units 4, adding to the number of manipulations required to complete the procedure.

The rotary sander of the present invention overcomes this shortcoming by providing a sliding securement between the sanding units and retaining sleeve thereof, as well as for the attachment of the brushes to the rotary drum. Along with other modifications this feature greatly facilitates the rapid and efficient disassembly of the rotary sander.

SUMMARY OF THE PRESENT INVENTION

The present invention has as a main object to provide a rotary sander having a structure which can be quickly assembled or disassembled without the need of extraneous hand tools.

In accordance therewith a rotary sander structure comprises a hollow rotary drum, a retaining sleeve concentrically disposed therein, and a securing first and second circular end pieces covering the bottom and top, respectively, of the drum.

A plurality of brushes are disposed around the periphery of the drum with the spines thereof being retained in conformingly shaped reentrant channels formed thereon.

Similarly, a plurality of sanding units comprising two or more sheets of sandpaper attached to an elongate plastic holder are disposed around the retaining sleeve with an external portion of each sandpaper sheet passing through a corresponding slot formed on the drum so as to be positioned between a pair of adjacent brushes. Each holder includes a retaining slat slidingly secured in a corresponding cooperating receiving groove formed around the periphery of the retaining sleeve.

Radially aligned locking protrusions formed around an inner periphery of the two end pieces as well as a threaded outer periphery on at least one of the end pieces engage corresponding grooves of the retaining sleeve on either end thereof and a threaded outer periphery of a respective end portion of the drum to secure the assembly together.

Replacement of the sandpaper sheets thus involves only the manual dislodging of one of the end pieces and simple sliding removal of the sanding units. Removal of the brushes is performed just as expediently by sliding them out of their respective receiving channels.

A detailed description of a preferred embodiment of the rotary sander of the present invention is provided below along with accompanying drawings.

A BRIEF DESCRIPTION OF THE DRAWINGS

DETAILED DESCRIPTION OF THE PREFERRED EMBODIMENT

Figure 1:
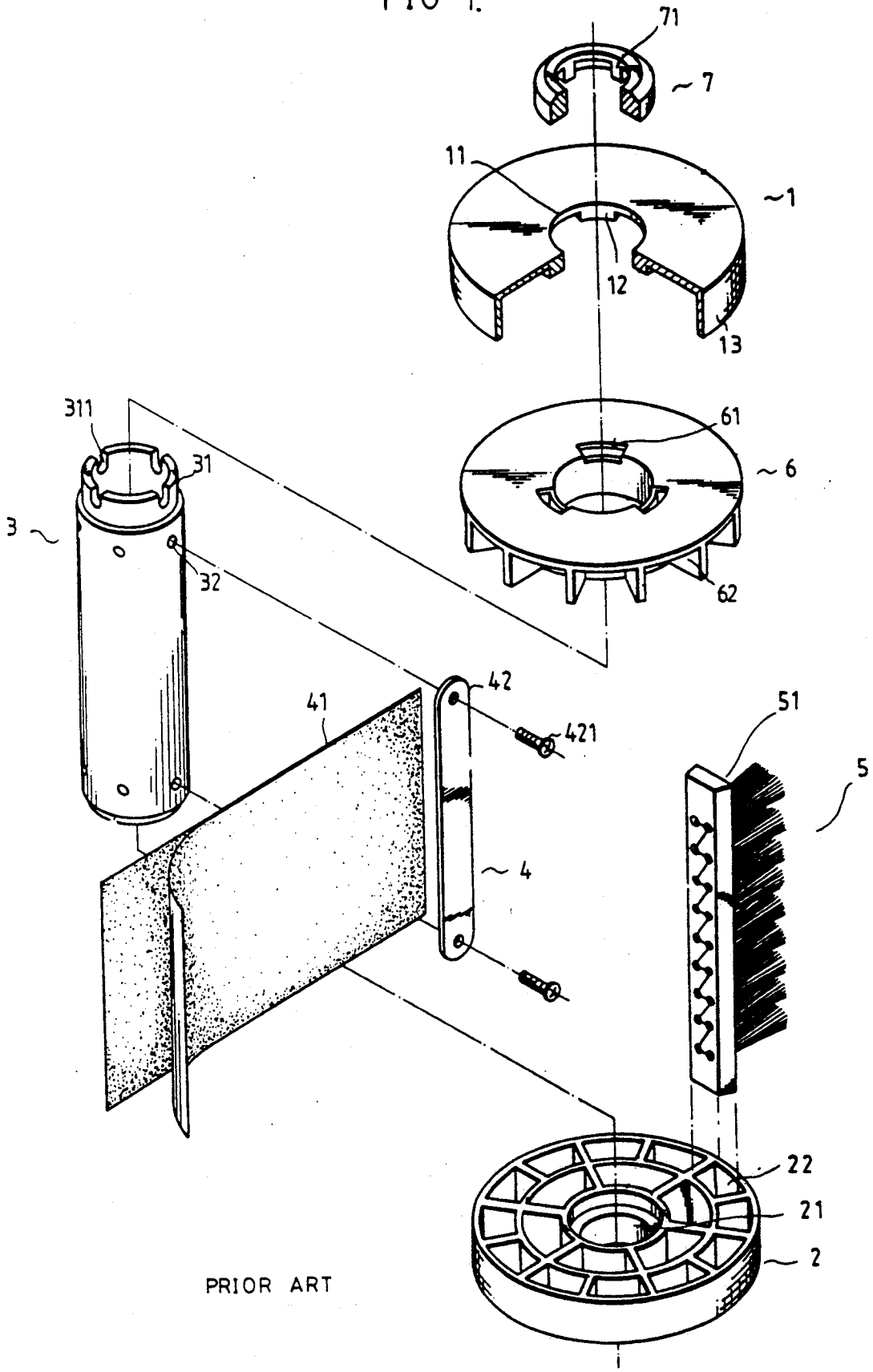
FIG. 1 is an exploded perspective view of a conventional type rotary sander.
Figure 2:
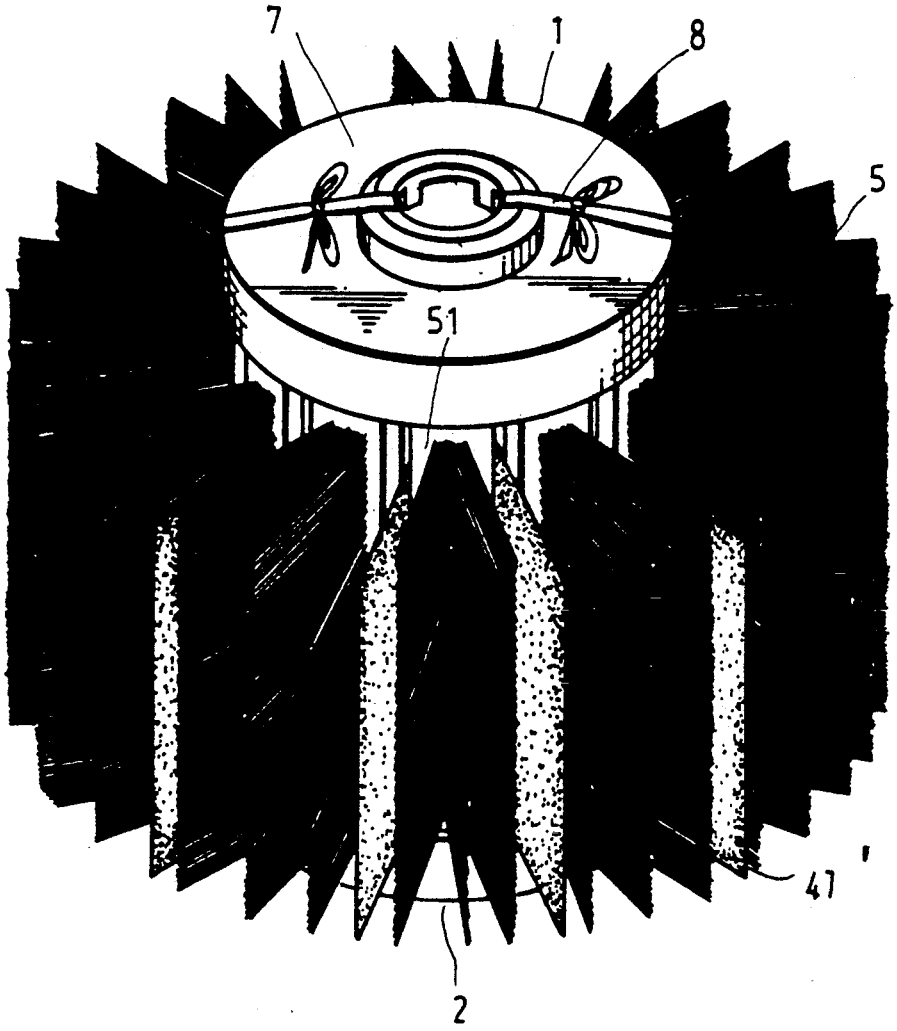
FIG. 2 is an assembled perspective view of the conventional rotary sander.
Figure 3:
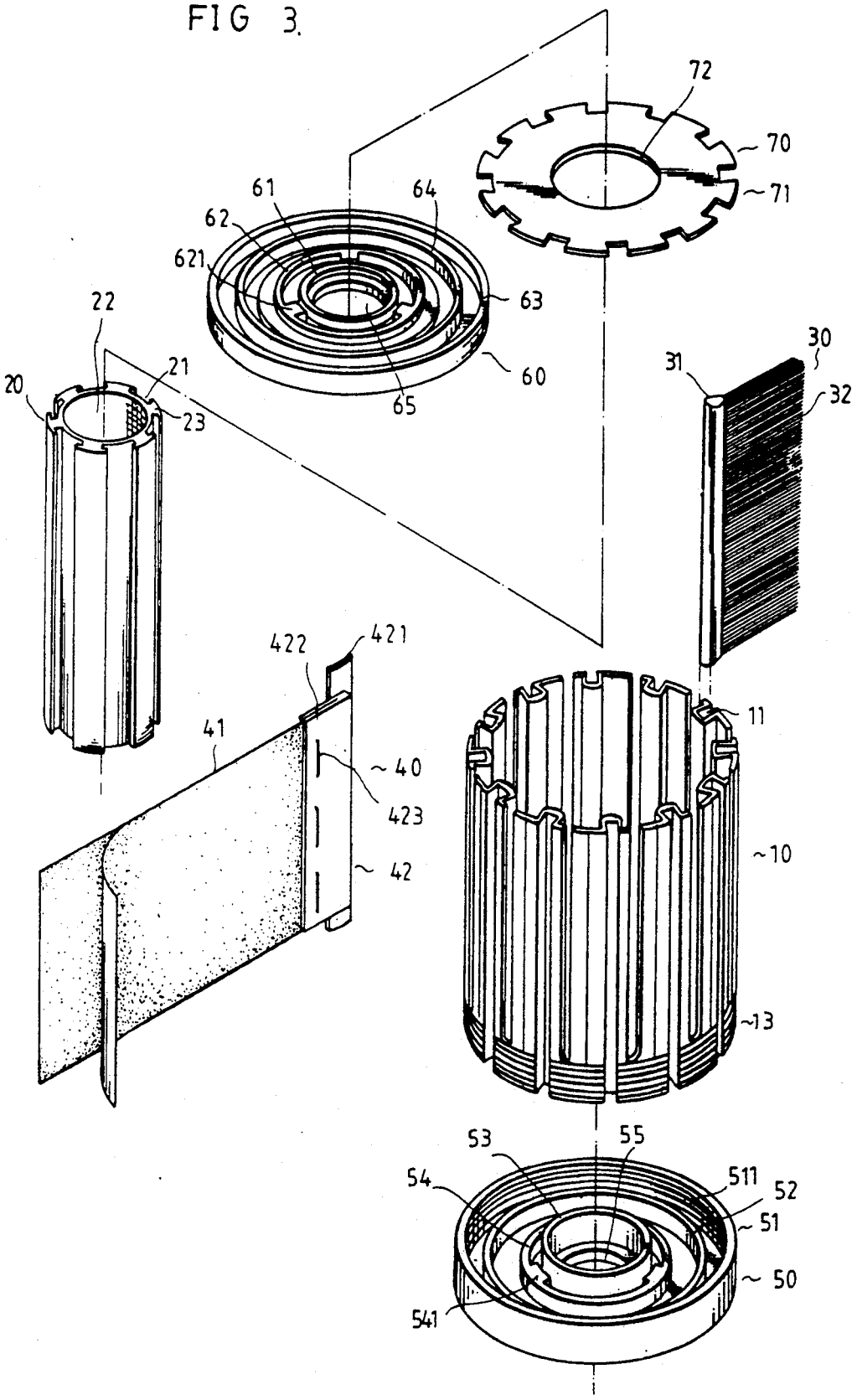
FIG. 3 is an exploded perspective view of an embodiment of the rotary sander of the present invention.
Figure 4:
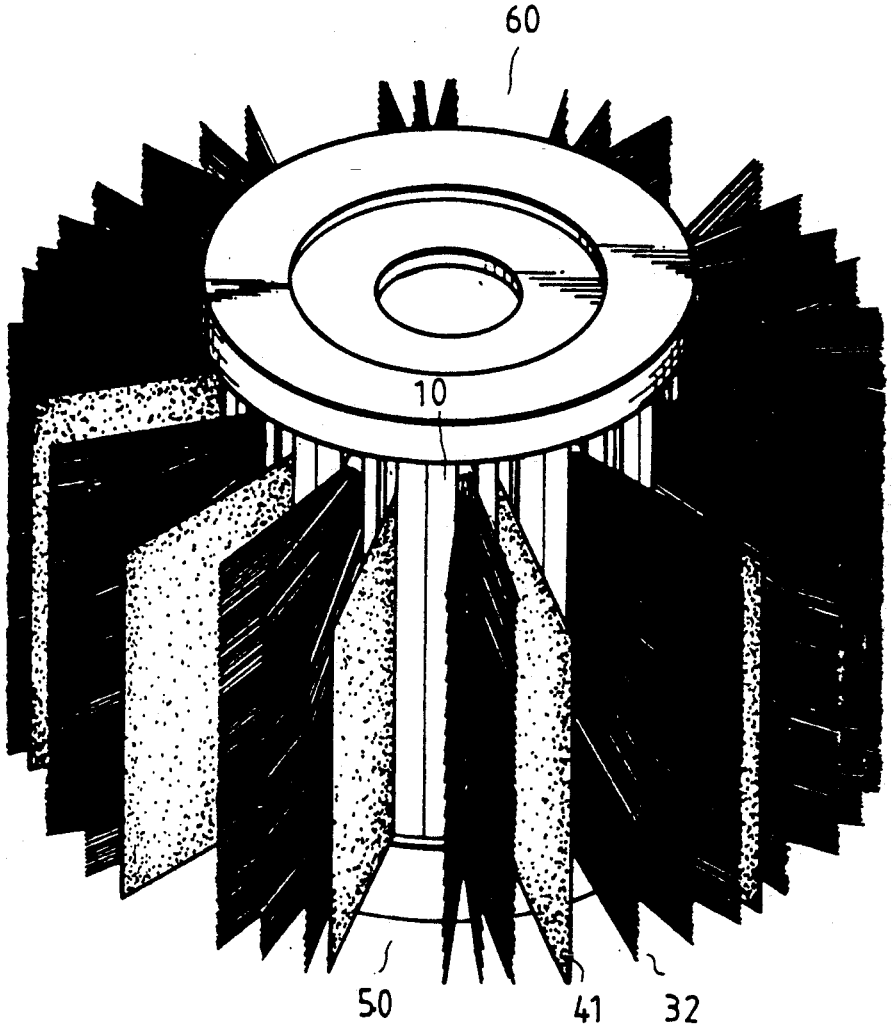
FIG. 4 is an assembled perspective view of the rotary sander of the present invention.

With reference to FIGS. 3 and 4, a preferred embodiment of the rotary sander of the present invention comprises a cylindrical rotary drum 10 having a concentric retaining sleeve 20 disposed therein, a plurality of brushes 30 held in radial positions thereon by a set of receiving channels 11, and a set of sanding units 40 held in corresponding receiving grooves 21 formed around the periphery of retaining sleeve 20. Each sanding unit carries two rectangular sheets of sandpaper 41 which extend through a pair of adjacent slots 12 on the rotary drum so as to be disposed between adjacent brushes 30 thereon. A circular first end piece 50 and second end piece 60 covering the open ends of the rotary drum secures the assembly together.

Twelve longitudinally aligned receiving channels 11 are formed around rotary drum 10 at equally spaced radial positions. Each receiving channel extends from the upper edge of the rotary drum to the lower edge thereof and has a reentrant cross section adapted to receive a similarly dimensioned elongate spine 31 of a corresponding brush 30. The spine in turn carries the narrow fiber bundle 32 of the brush.

An equal number of elongate positioning slots 12 are also formed around the periphery of the rotary drum between respective adjacent pairs of receiving channels 11 thereon. The positioning slots extend downward from the upper edge of the rotary drum and terminate near a lower end portion thereof on which is formed a discontinuous circumferential threading 13, being interrupted as it is by the presence of the receiving channels.

An upwardly projecting circumferential rim 51 formed around first end piece 50 has a threaded inner periphery 511 adapted to engage threading 13 on the rotary drum when the endpiece is secured thereunder. Similarly, a concentric, annular band 52 formed spacedly from rim 51 in the end piece abuts an inner portion of the receiving channels 11 when the two members are engaged.

Retaining sleeve 20 has a cylindrical inner periphery 22 and an outer periphery carrying six equally spaced radial splines 23 extending along the length thereof. Each spline has a mushrooming cross-section with overhanging outer edges that extend respectively in either circumferential direction, so as to define a reentrant longitudinal receiving groove 21 between each pair of adjacent splines 23.

Prior to the mounting of the sanding units 40 in receiving grooves 21, the retaining sleeve is first secured to end piece 50 which has been attached to the rotary drum as was described above. To facilitate this, an inner bushing 53 and concentric outer bushing 54 are provided near the center of end piece 50. One end of retaining sleeve 20 is inserted into the space therebetween so that the outer periphery of inner bushing 53 abuts the inner periphery 22 thereof and the inner periphery of outer bushing 54 abuts the outer faces of the splines 23. Concomitantly, a set of three equally spaced locking protrusions 541 formed on the inner periphery of the outer bushing and projecting radially inwards therefrom engages corresponding receiving grooves 21 to secure the retaining sleeve therein.

Each of the sanding units 40 has an elongate PVC holder 42, with the pair of rectangular sheets of sandpaper 41 attached thereto. The holder itself comprises an arcuate retainer slat 421 adapted to be slidingly received in a groove 21 of the retaining sleeve, and a holder strip 422 adjoined to the outer face of the retainer slat. A corresponding edge portion of each sheet of sandpaper 41 is clamped between the split sides of the holder strip and secured therein by staples 423.

The retainer slat 421 of each of six provisional sanding units 40 is then inserted into a respective retaining groove in sleeve 20. Concurrently, each of the two sandpaper sheets 41 of the respective sanding units are guided into respective adjacent slots 12 on the rotary drum.

The spines 31 of brushes 30 are likewise slid into respective receiving channels 11 thereon, so that the external portions of the twelve sandpaper sheets 41 would be interposed between the twelve brushes 30.

An annular partition plate 70 can then be disposed within the rotary drum so as to rest against the upper edges of the sandpaper sheets 41 therein. Plate 70 has a serrated outer periphery 71 conforming in shape with the inner cross-section of drum 10 and a central hole 72 which circumscribes sleeve 20, so as to provide an abutment therebetween for greater rigidity. A sufficient space is preserved between the plate 70 and the upper ends of the drum and sleeve to allow the placement of end piece 60 thereover.

As with the lower end piece, end piece 60 has a similar inner bushing 61 and outer bushing 62 with locking protrusions 621 thereon for engaging the upper end portion of retaining sleeve 20. Similarly, a circumferential rim 63 and concentric inner annulus 64 are provided for abutment with the outer periphery of the drum and the inner portions of the receiving channels, respectively, though no threaded securement therebetween is implemented.

The assembly of the rotary sander is thus completed when end piece 60 is secured over the top of the rotary drum and retaining sleeve therein. A central axle hole 55 and 65 are formed on respective end pieces 50 and 60 for the passage of a spindle through retaining sleeve 20. Afterwhich, the rotary sander could be rotatingly coupled therewith.

Disassembly of the rotary sander can be implemented just as rapidly with preferably the upper end piece 60 being removed only, for access to the sanding units or brushes which can be slid out from their receiving grooves or channels. Thus, as compared with the aforedescribed conventional type of rotary sander, there are no screws requiring manipulation by handtools nor is separation of all components therein required.

Numerous variations and modifications to the rotary sander of the present invention could be made by a person of average skill in the art and as such the above description of the preferred embodiment thereof should be construed as being exemplary rather than limitative, with the actual scope of the present invention being determined by the appended claims.

I claim:

1. A rotary sander comprising:

a generally cylindrical rotary drum having a plurality of receiving channels and an equal number of slots formed around the outer periphery thereof, said receiving channels extending from an upper edge of said drum to a lower edge thereof and having a reentrant cross section, said slots being disposed between respective adjacent receiving channels and extending from an upper edge of said drum to proximity with a lower edge thereof;

a first circular end piece and a second circular end piece secured over respective top and bottom openings of said drum, each said end piece having a central hole and concentric inner and outer bushings formed thereon;

a retaining sleeve having a cylindrical inner periphery and a predetermined number of equally spaced radial projections formed around the outer periphery thereof, with said projections extending axially from the upper end of said retaining sleeve to the lower end thereof and defining a receiving groove of reentrant cross section between each pair of adjacent protrusions, said retaining sleeve being concentrically disposed within said drum with the end portions thereof being secured respectively by said inner and outer bushings on said first and second end pieces;

a set of brushes with each said brush having an elongate spine and a fiber bundle strip attached thereto, each said spine being disposed in a respective receiving channel and having a cross section adapted for the sliding securement of said brush therein;

a set of sanding units each having two or more rectangular sheets of abrasive paper and an elongate holder attached to an arcuate retainer slat a corresponding edge of each said sheet of abrasive paper secured to said elongated holder said sanding unit being attached to a respective receiving groove with said retaining slat disposed therein, each said sheet of sandpaper passing through a corresponding slot on said drum so that an external portion of each said sheet of sandpaper is disposed between each pair of adjacent said brushes;

wherein, a spindle can be passed through said central holes on respective said first and second end pieces and said inner periphery of said retaining sleeve, and engaged with said rotary drum.

2. A rotary sander according to claim 1, wherein said outer bushings of said first and second end pieces include a set of radial inwardly projecting protrusions formed on the inner periphery thereof adapted for engaging corresponding receiving grooves of said retaining sleeve, releasably securing said first and second end pieces therewith.

3. A rotary sander according to claim 2, wherein at least one of said end pieces has a circumferential rim with a threaded inner periphery and a concentric annulus spaced from said rim formed thereon, said rim being adapted to threadedly engage a corresponding circumferentially threaded end portion of said drum with said annulus abutting an inner portion of said receiving channels.

4. A rotary sander according to claim 1, wherein said elongate holder of each said sanding unit includes an elongate holder strip adjoined to the front face of said retaining slat thereof, a corresponding edge portion of each said sheet of sandpaper of said sanding unit being clamped between split sides of said holder strip and secured thereon by staples.

5. A rotary sander according to claim 4, wherein said holders of said sanding units are made from a polyvinyl chloride plastic.

* * * * *